US006415571B2

(12) United States Patent
Risser

(10) Patent No.: US 6,415,571 B2
(45) Date of Patent: Jul. 9, 2002

(54) SUB-DECK DRAINAGE SYSTEM OR GUTTER COMPRISING A TRAPEZOIDAL SHAPED PANEL OF THERMOSET, THERMOPLASTIC, OR MODIFIED BITUMEN MEMBRANE

(76) Inventor: Keith B. Risser, 6638 Corina Ct., Columbia, MD (US) 21044

( * ) Notice: Subject to any disclaimer, the term of this patent is extended or adjusted under 35 U.S.C. 154(b) by 0 days.

(21) Appl. No.: 09/836,835

(22) Filed: Apr. 13, 2001

Related U.S. Application Data

(62) Division of application No. 09/546,740, filed on Apr. 11, 2000.

(51) Int. Cl.[7] ..... E04B 1/70
(52) U.S. Cl. ..... 52/302.1; 52/11
(58) Field of Search ..... 52/11, 15, 302.1, 52/302.3

(56) References Cited

U.S. PATENT DOCUMENTS 4,065,883 A * 1/1978 Thibodeau ..... 52/11
5,511,351 A * 4/1996 Moore ..... 52/302.1
6,167,717 B1 * 1/2001 Dudley et al. ..... 62/291

* cited by examiner

*Primary Examiner*—Beth A. Stephan
*Assistant Examiner*—Naoko Slack
(74) *Attorney, Agent, or Firm*—William S. Ramsey

(57) ABSTRACT

Five examples of the system for waterproofing an outside deck, thereby improving the usefulness of the space below the deck, are disclosed. Both inflexible and flexible panels are used. All panels may be made of fire retardant materials. Examples of both types of panels are installed at the time the deck is constructed and fit between the joists. They consist of panels which may be used in conjunction with each other in order to protect decks of varying widths. The other examples are added to previously constructed decks. One example includes a clip strip which is attached to the bottom of the joists and panels which are attached to the clip strip. A trim piece completes the installation. A second example involves the flexible panel with provisions for connection to a mounting bracket installed between the joists. Another example involves a flexible panel which may be installed by the homeowner along the bottoms of the joists. In each system there are provisions for insuring that the system remains waterproof.

7 Claims, 12 Drawing Sheets

SUB-DECK DRAINAGE SYSTEM OR GUTTER COMPRISING A TRAPEZOIDAL SHAPED PANEL OF THERMOSET, THERMOPLASTIC, OR MODIFIED BITUMEN MEMBRANE

This is a divisional application of Ser. No. 09/546,740, filed Apr. 11, 2000, pending.

BACKGROUND OF THE INVENTION

Field of the Invention

This invention relates to a system for draining the valleys formed between the boards forming the surface of a deck, thereby providing a dry, rain-free area below the deck.

DESCRIPTION OF RELATED ART INCLUDING INFORMATION DISCLOSED UNDER 37 CFR 1.97 AND 37 CFR 1.98

Waterproofing an outside unroofed deck, and thereby obtaining dry useful roofed space at minimal expense, has been an unsolved problem for some time. Part of the appeal of an outside deck is its rustic appearance, and approaches to waterproofing which disrupts the appearance are not acceptable. It is also desirable that the waterproofing system be fire retardant to minimize the hazard from carelessly discarded smoking, cooking materials and fire starting fluids such as charcoal lighter fluid.

U.S. Pat. No. 4,065,883 discloses a system for waterproofing the area below a deck constructed of spaced boards. The system consists of elongated channels with flanges which overlap on the top of spaced joists. The channels are installed before the boards which cover the deck are fixed in place. A cap is formed at one end of the channel, and the channel walls gradually increase in length along the length of the channel, providing a gradient for the water flow. There are no provisions for connecting multiple channels to accommodate wide decks. U.S. Pat. No. 5,195,281 discloses a deck trough mounted between the joists with lips which overlap over the top of the joists. The trough has a shallow enclosed end and a deep-end with an outlet, which may consist of a cut-out to allow water to flow from the trough or may be a closed end with a pipe outlet.

U.S. Pat. No. 5,511,351 discloses a drainage system for decks which uses sheets of waterproof material to drape between adjoining joists. The overlap between sheets is sealed using a bead of waterproof caulking. The system may be installed after the deck is constructed. The slope necessary for the conduct of water through the system is obtained by mounting one end of the channeling members higher on the joists than the other end, except in cases where local building codes require that the surface of the deck itself have an incline. In the latter case, a trim molding is attached to the bottom of the joists, thereby covering the seam between adjacent sheets.

U.S. Pat. No. 4,860,502 discloses a deck gutter system for installation after the deck has been constructed. In this system, gutter hanger strips are mounted on adjacent deck joists with the strips sloping from the back of the deck to the front. An elongated deck gutter with a uniform cross section along its entire length is supported by the gutter hanger strips. The deck gutters have Z shaped extension bands along their entire lengths to accommodate variations in the spacing of the joists.

None of the prior meets the objectives of the present invention, that of providing a modular deck drainage system which can accommodate a deck of any width yet uses only components of modest length. The present invention has five embodiments, two of which are installed during deck construction, and three of which are added to existing decks.

BRIEF SUMMARY OF THE INVENTION.

This invention is a modular drainage system for decks attached to structures such has houses, which collects and carries away for disposal water resulting from rain or snow on the surface of an unroofed deck. Deck boards made of wood or composite materials are typically spaced apart to accommodate swelling of the boards and to drain a deck. This invention waterproofs the deck without affecting the desirable rustic appearance of the top of the deck. A large area below each deck thus becomes much more useful than when the area was subject to drainage from the top of the deck. The first two embodiments of the invention include two types of panels, the first panel includes a dam which closes the end which is adjacent to the structure. The other end of the first panel is open so water may freely flow from it and it has connectors for attaching to a second panel. The second panel is open at either end and has connectors for attaching to a first panel and to additional second panels, if necessary.

By the use of the first and second panels of the first two embodiments, decks of a wide variety of widths may be waterproofed with this invention. If the deck width is not an even multiple of the length of the modules, a second panel may be cut to the desired length.

The third and fourth embodiments of the invention are in the form of flexible panels which are precut to a length adequate to span the width of the deck.

The fifth embodiment is in the form of flexible panels which are installed on an existing deck.

A gutter and down spout system can be mounted to receive the water at the edge of the deck or it can be simply allowed to drain from the panels.

Five embodiments of the invention are disclosed. The first embodiment is designed for installation during deck construction. The panels fit between the joists and the panel lips overlap the joists. The panels are secured in place by nails or screws which also may secure in place the deck boards.

The second embodiment of the invention is designed for addition to an existing deck. A clip strip is attached along the length of the joists and the panels are attached to the clip strip. A trim piece may be used to cover the joint between adjacent panels and to give the underside of the deck a uniform appearance.

The third embodiment is designed for installation during deck construction. The panel material is flexible fire retardant rubber, plastic, or other elastomer which may contain fiberglass. The panel is in the shape of a keystone or trapezoid and is installed between the joists with panel lips overlapping the joists. A diversion flange is installed over the panel lips. The fall of the panel which allows water to flow down the panel is provided by the shape of the panel, with two parallel ends, a wide and a narrow end, and straight sides connecting the ends. The panel is installed with the narrow end adjacent to the structure.

The fourth embodiment provides an additional attachment strip for use in installing third embodiment panels on an existing deck. The attachment strip extends along the interior sides of the joists and the third embodiment panels are attached to the strip. The fall is provided by the panels.

The fifth embodiment is identical to the third embodiment except that it is installed under the joists of an existing deck and may be installed by the homeowner.

The object of this invention is to waterproof an unroofed deck.

Another object is to collect and drain water from a deck.

Another object is to upgrade the space under a deck by protecting it from water which drains from the deck.

Another object is to provide a deck drainage system for installation at the time of deck construction.

Another object is to provide a deck drainage system which is installed on a previously constructed deck.

Another object is to provide a fire retardant deck drainage system.

Another object is to provide a modular deck drainage system which can accommodate decks of any width.

Another object is to provide a modular deck drainage system comprised of practical and simple components which can be handled, carried, manipulated, transported, stored and installed easily and safely and without suffering damage to the product during these activities.

Another object is to provide a deck drainage system constructed of materials which withstand ultraviolet light and ozone degradation, salt water in direct spray and in the air, incidental contact and abuse, rough jobsite handling, caustic accumulations of debris and acid rain, snow and ice build up, and retain resilience during extreme temperature changes.

Another object is to provide a modular deck drainage system adaptable to the widest deck yet made up of components which can be packaged and shipped by commercial shipping services within the normal shipping standards.

Another object is to provide a deck drainage system which does not distract from the rustic appearance of a deck.

Another object is to provide a deck drainage system which has an attractive appearance when viewed from the underside of the deck.

Another object is to protect the framing and joists of a deck from water damage.

Another object is to provide a modular drainage system which is effective and easy to install by the ordinary handyman such as the typical homeowner using tools usual to the average household.

Another object is to provide a deck drainage system which is easily constructed, inexpensive, and without adverse impact on the environment.

DETAILED DESCRIPTION OF THE INVENTION

Figure 1A:
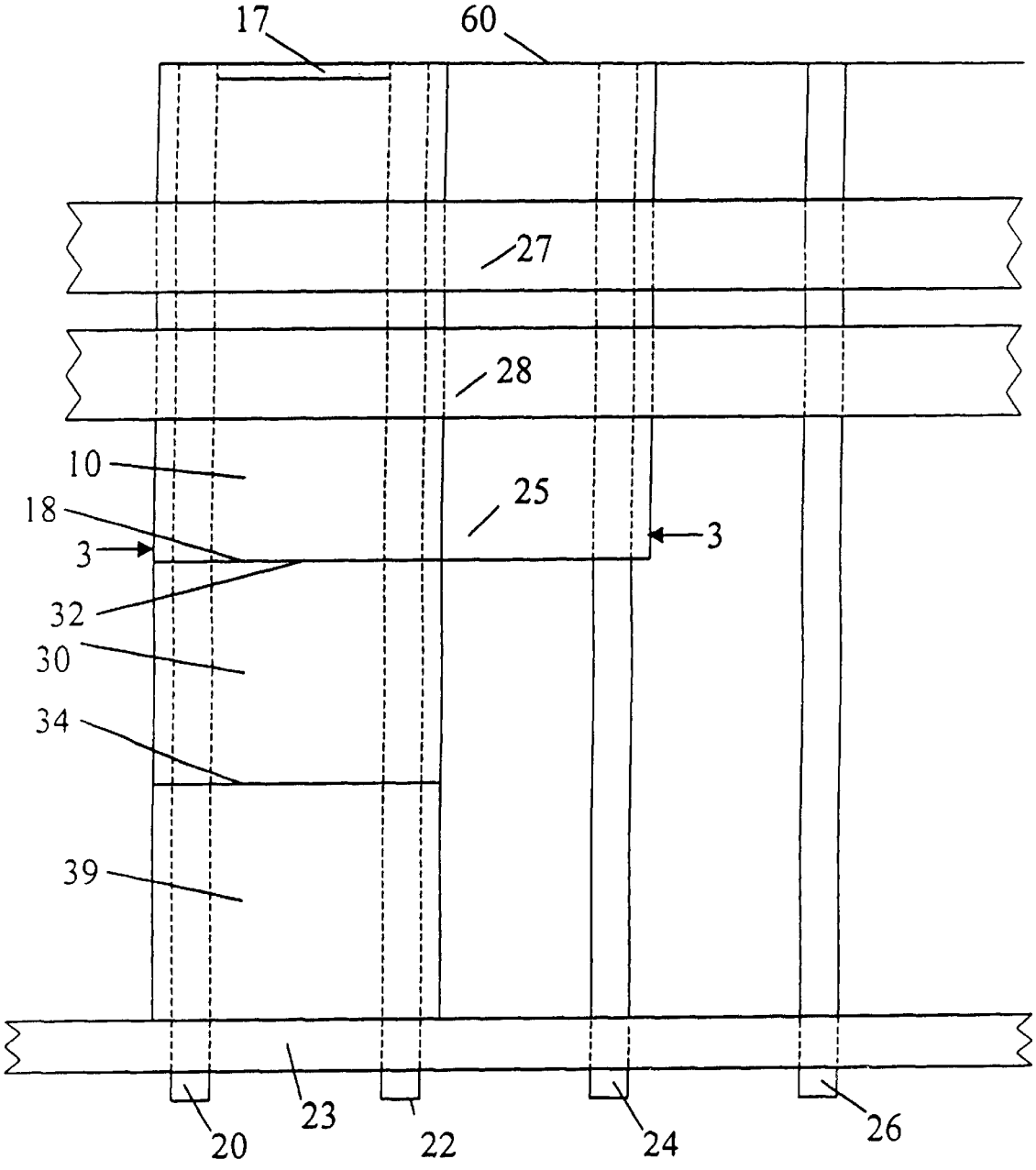
FIG. 1A is a top view of a deck showing the first embodiment deck drainage system.

FIG. 1A shows a top view of the first embodiment or original construction embodiment of the invention showing the relationships between the modular components of the deck drainage system and the elements of the deck. The structure is a house or other structure with an attached unroofed deck. The side 60 of the structure is shown in FIG. 1A. Joists 20, 22, 24, and 26 extend out from and may be attached to the side of the structure 60. The joists may be supported at one end by attachment to the structure and are also supported by a post and beam system under and supporting the joists (posts and beams not shown in FIG. 1A). The joists typically have nominal dimensions of 2"×8"×16' and extend from the structure to the edge of the deck. Deck boards 27, 28 are attached, typically by nails or screws, to the joists at right angles to the joists. The deck boards provide the walking surface of the deck. Deck boards are separated from each other by a space of ⅛" to ¼" to provide for deck drainage of rain and snow and to accommodate the swelling and shrinkage of the deck boards.

A headwater flashing is installed with all new construction embodiments of the deck drainage system. The headwater flashing aids in insuring that water does not infiltrate between the side of the building and the ends of the deck drainage system panels which are nearest to the building.

Figure 1B:
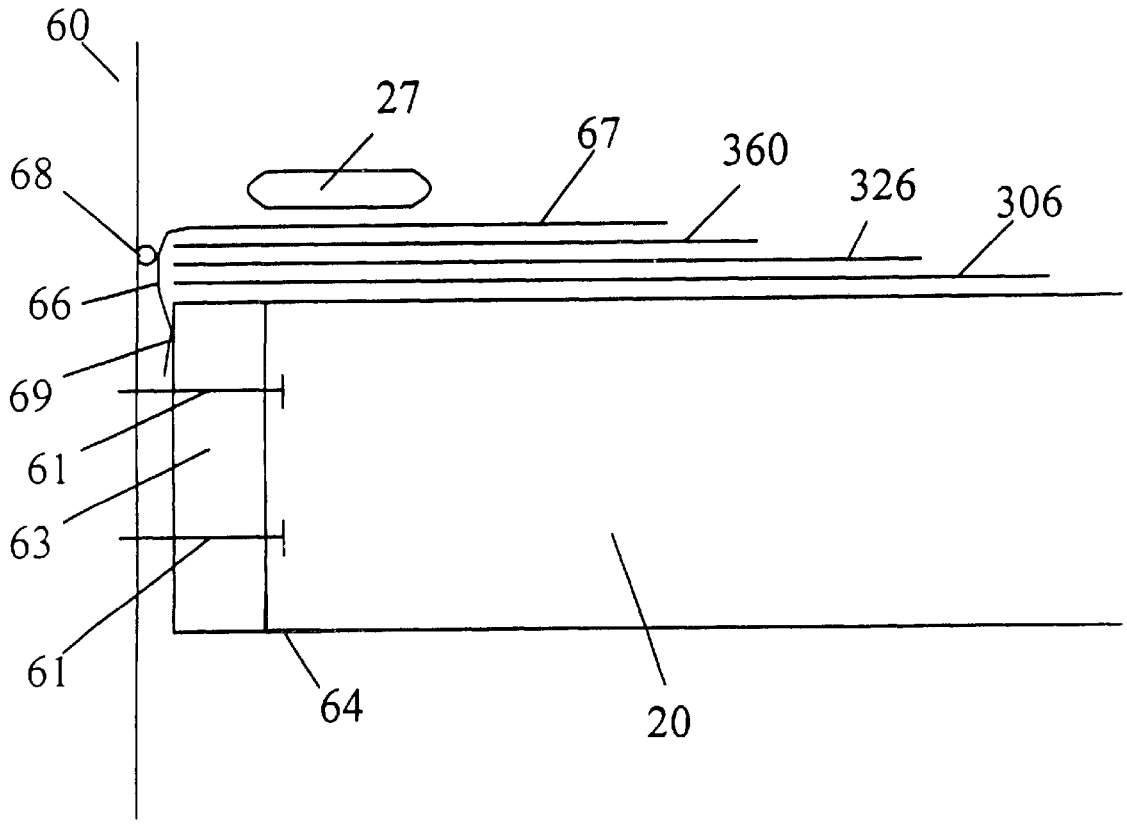
FIG. 1B is a cross-section view of the attachment of joists to the building showing the headwater flashing.

FIG. 1B shows the side of the building 60. In typical deck construction a ledger board 63 of width approximately the same as the width of the joists is attached to the building 60 by fasteners 61. Ledger board 63 is installed horizontal to the ground and extends the length of the deck. Joist hangers 64 are attached to the ledger board 63 and one joist 20 is attached to each joist hanger. Of course, other methods for attaching the joists to ledger board may be used. The headwater flashing 66 is a strip of flexible impervious membrane such as EPDM or TPO of a length approximating the length of the deck and approximately 10" in width. The flashing 66 is installed between the building 60 and the ledger board 63 by stapling the flashing 66 to the ledger board 63 with approximately 1½" 69 of flashing 66 extending below the top of the ledger board. A bead of construction adhesive or caulk 68 is placed between the flashing 66 and building 60 to protect against water infiltration. Alternatively, rubber screen bead may be used instead of caulk 68. After the joist 22 , deck drainage panels, 306 and 326, and diversion flange 360 are installed, the portion 67 of the flashing extending above the ledger board is folded down covering the panels and diversion flange for a distance of about 7" from the building. The deck boards 27 are then installed and construction of the deck proceeds. It is recommended several of the deck boards nearest the ledger board be secured by screws or other fasteners which will allow periodic removal of the boards so the deck drainage system may be flushed with water from a garden hose. This will insure removal of leaves and other debris which may have fallen between the deck boards and have become retained by the drainage system.

FIG. 1A shows the first embodiment deck drainage system consists of a varying number of modules which are placed between the joists during construction of the deck and which are overlaid by the deck boards and are held in place by the fasteners which attach the deck boards to the deck. Here the modules or panels, first panel 10, second panel 30 and third panel, 39 are attached to joists 20 and 22 and are overlaid by deck boards 27 and 28. Another first panel 25 is shown attached to joists 22 and 24 in order to show the relationship between first panel 10 and the adjacent similar first panel 25. First panel 10 has a dam 17 which closes the end of the first panel at the end nearest the structure 60. The second panel 30 is attached to the other end of the first panel 10 by the first panel interlock 18 and the second panel interlock 32. At the other end of the second panel 30 is the second panel interlock 34. There are only two types of panels, a first and a second type. First type panels have a dam at one end and an interlock at the other end. Second type panels have an interlock at either end. Additional length is obtained by using additional panels of the second type, here called a third panel 39, although it will be seen that third and additional panels also require modifications in the side walls. Any number of second type panels may be used to accommodate decks of varying widths. In addition, a panel may be cut to accommodate a deck whose width is not an even multiple of the panel length.

A conventional gutter 23 is shown running perpendicular to the deck drainage modules or panels. This gutter collects water from the panels and conveys it away from the deck for disposal. Alternatively, the modules may be allowed to drain water directly onto the ground.

A convenient length for a panel is 8 feet. This length is easily handled and may be shipped by commercial shipping services. The panels are structured to fit between joists which are 16" center to center. As will be described below, provisions to accommodate variations in the distance between joists are provided.

Figure 2A:
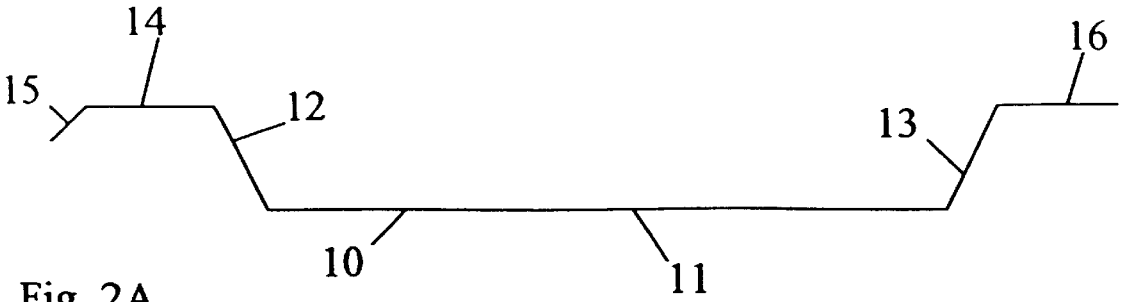
FIG. 2A is a cross-sectional view of a first embodiment panel.

FIG. 2A is a cross-section through the middle of a first embodiment module. Both first and second panels have the same cross-section through the middle. First and second panels differ primarily in that a first panel has a dam at one end, while both ends are open in second panels. As will be seen later, there also are differences in the heights of the side walls between first and second panels. FIG. 2A shows the bottom 11 of the panel, the left side wall 12 and right side wall 13. In a preferred embodiment the side walls are attached to the bottom at an angle about 10° in order to facilitate the stacking of panels for shipping and storage. A left horizontal lip 14 is attached to the left wall 12 and a right horizontal lip 16 is attached to the right wall 13. A downwardly inclined flange 15 is attached to the left horizontal lip 14 to facilitate water diversion and prevent backflow.

Figure 3:
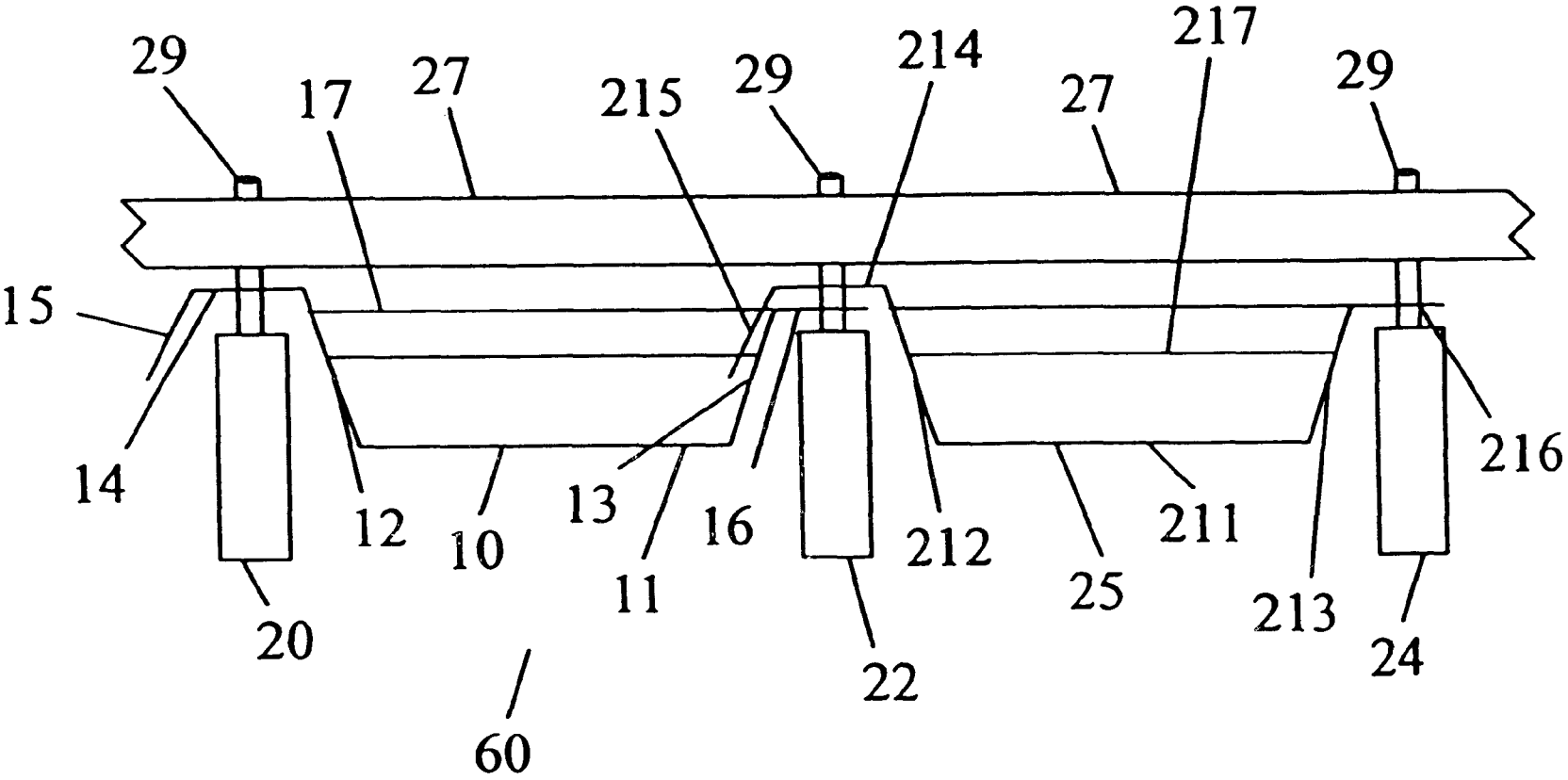
FIG. 3 is a cross-sectional view of the first embodiment deck drainage system of FIG. 1 taken along line 3—3.

FIG. 3 is a cross section of the deck of FIG. 1 taken along the line 3—3. The house or structure 60 is visible at the back of the figure. Joists 20, 22, 24, and 26 extend perpendicularly from the side of the structure 60 and are visible in cross section.

The first panel 10 is shown in cross section, and is also shown in FIG. 2A. The dam 17 at end of the first panel 10 and adjacent to the structure 60 is visible. Also shown is the bottom 11, left wall 12, right wall 13, right horizontal lip 16, left horizontal lip 14, and left panel flange 15. The left horizontal lip 14 extends over the width of the joist 20 and the left panel flange 15 extends downwardly on the left side of joist 20. The right horizontal lip 16 approximately covers the width of the joist 22. It is important to note that this cross-section structure, which is common to all of the panels of the first embodiment or original construction embodiment deck drain, common to the first, second and third or subsequent panels, has provisions for accommodating joists with varying distances between the joists. Although the distance between joists is nominally fixed, and constant, in fact there is considerable variation in the distance between joists. This variation is accommodated by varying the amount of overlap between the right horizontal rib and the joist upon which it rests. If the joists 20 and 22 are closer together than normal, the right horizontal web 16 overlaps the entire joist 22 width. If the joists are further apart than normal, the right horizontal web 16 overlaps less than the entire joist 22 width, perhaps only ¼th or ⅓rd of the width. In addition, the left horizontal rib 14 is wide enough that additional variation can be accommodated by the distance between the left wall 12 and joist. Of course, only a reasonable amount of variation in distance between joists can be accommodated. If joists are too far apart the right horizontal rib 16 will not reach joist 22 even if the left panel flange is up against the left side of joist 20.

FIG. 3 shows an adjacent first panel 25. Panel 25 is identical to panel 10. FIG. 3 shows the dam 217 at end of the first panel 25 and adjacent to the structure 60. Also shown is the bottom 211, left wall 212, right wall 213, right horizontal lip 216, left horizontal lip 214, and left panel flange 215. The left horizontal lip 214 extends over the width of the joist 22 and the left panel flange 215 extends downwardly on the left side of joist 22. The right horizontal lip 216 approximately covers the width of thejoist 24. Note the left horizontal rib 214 covers the right horizontal rib 16 of adjacent panel 10. The left panel flange 215 overlaps the right wall 13 of panel 10 and effectively seals the joint between adjacent panels 10 and 25 against leakage of water and backflow.

FIG. 3 also shows a deck board 27. Fasteners such as nails or screws used to secure the deck boards to the joists also penetrate the horizontal ribs of panels 10 and 25 and secure the panels in place. Obviously, the panels of this first embodiment must be put in place during construction of the deck.

Figure 4:
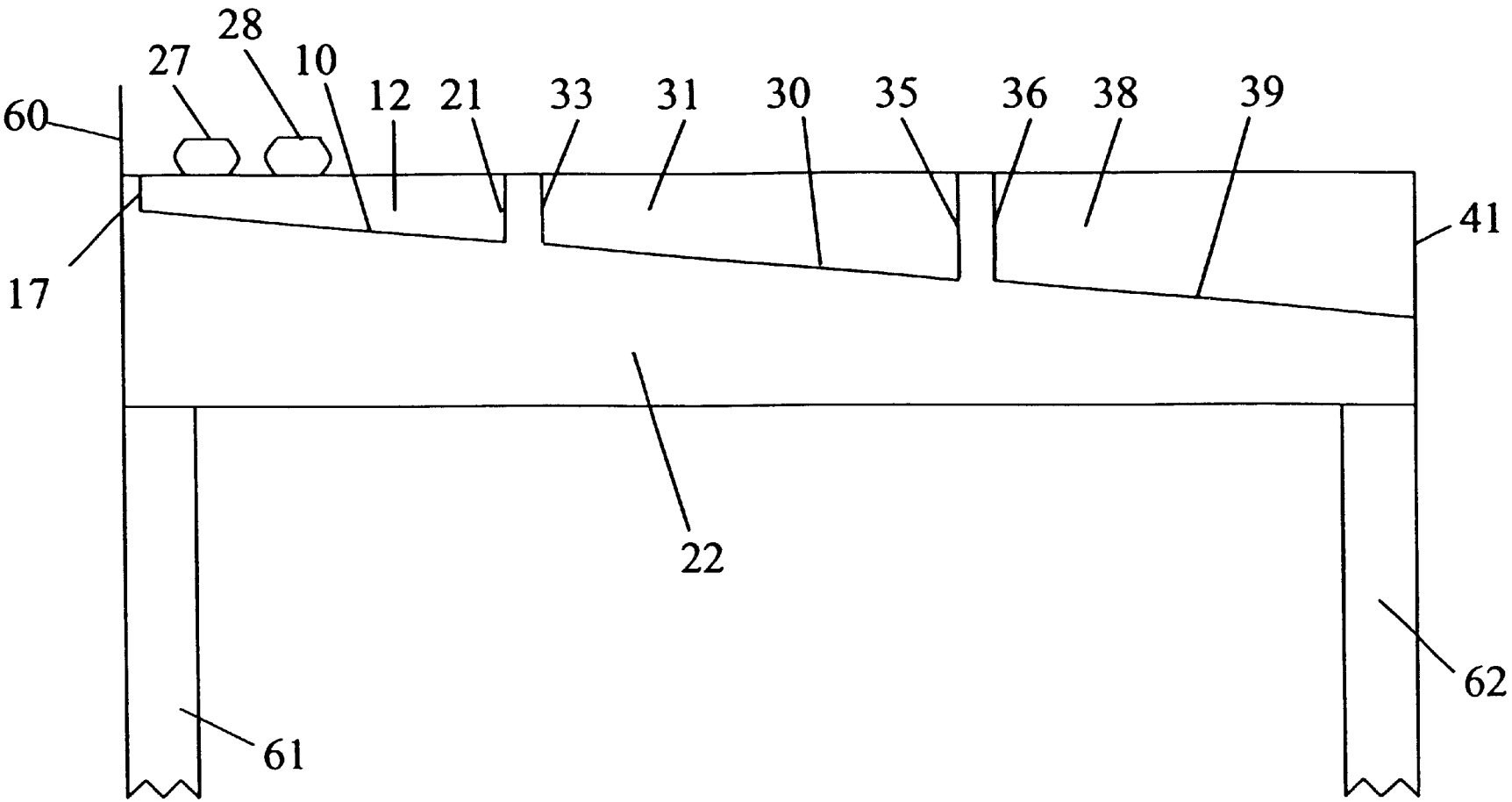
FIG. 4 is a side view of a joist with the first embodiment deck drainage system installed.
Figure 8A:
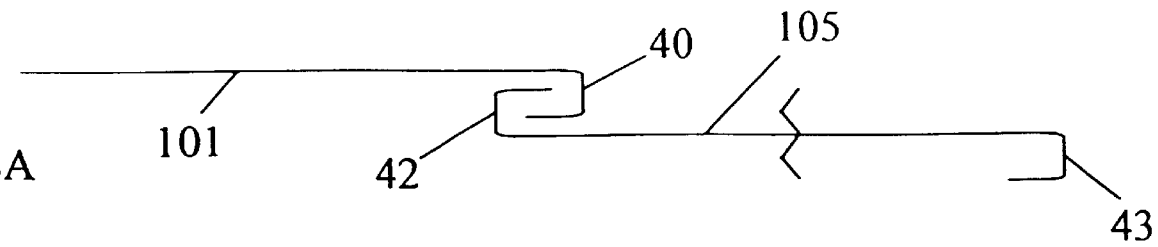
FIG. 8A is a cross-sectional view of a first and a second panel interlocked by the U-shaped interlock.
Figure 8B:
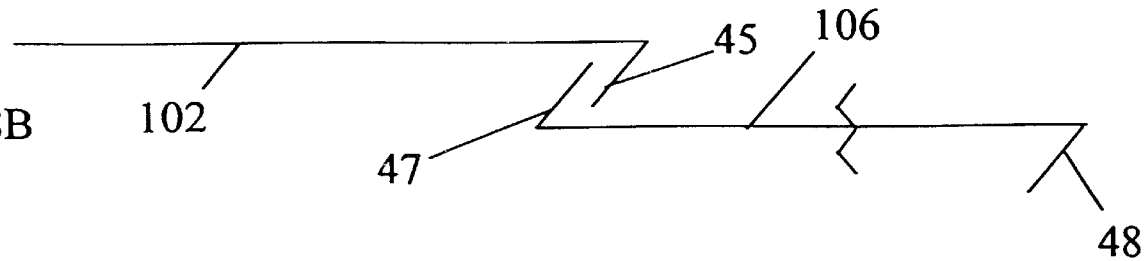
FIG. 8B is a cross-sectional view of a first and a second panel interlocked by the Z-shaped interlock.
Figure 8C:
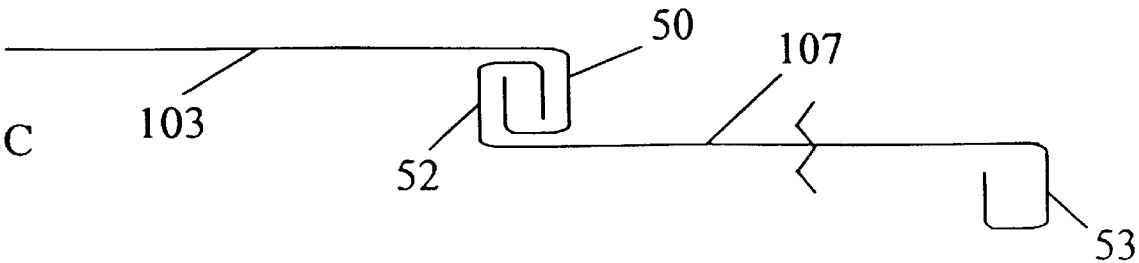
FIG. 8C is a cross-sectional view of a first and a second panel interlocked by the spiral interlock.

FIG. 4 is a side view along the length of a joist 22 showing the installation of the first embodiment or original installation deck drainage system. Joist 22 extends from the structure 60 out to the edge of the deck. The first panel 10 is closest to the structure, with the dam adjacent to the structure 60. The first panel 10 is attached by an interlock to the second panel 30 which, in turn, is attached by an interlock to the third panel 39. Details on the interlocks is shown in FIGS. 8A–C. It is important that the bottom of the panels slope downwardly from the structure to the edge, to allow for drainage from the deck. In a preferred embodiment the slope is a minimum of ⅛" for every linear foot of panel length. In a preferred first panel, the side walls at the dam 17 are 2" high, and at the open end 21 which is 8 feet from the dam, the walls are 3" high. In the second panel, the walls at the end 33 which is attached to the first panel are 3" high and the walls at the other end 35 are 4" high. In the third panel, the walls at the end 36 attached to the second panel are 4" high and at the other end the walls are 5" high. Of course, the dimensions given here are illustrative only of a preferred example and do not limit the claims of this application.

Figure 5:
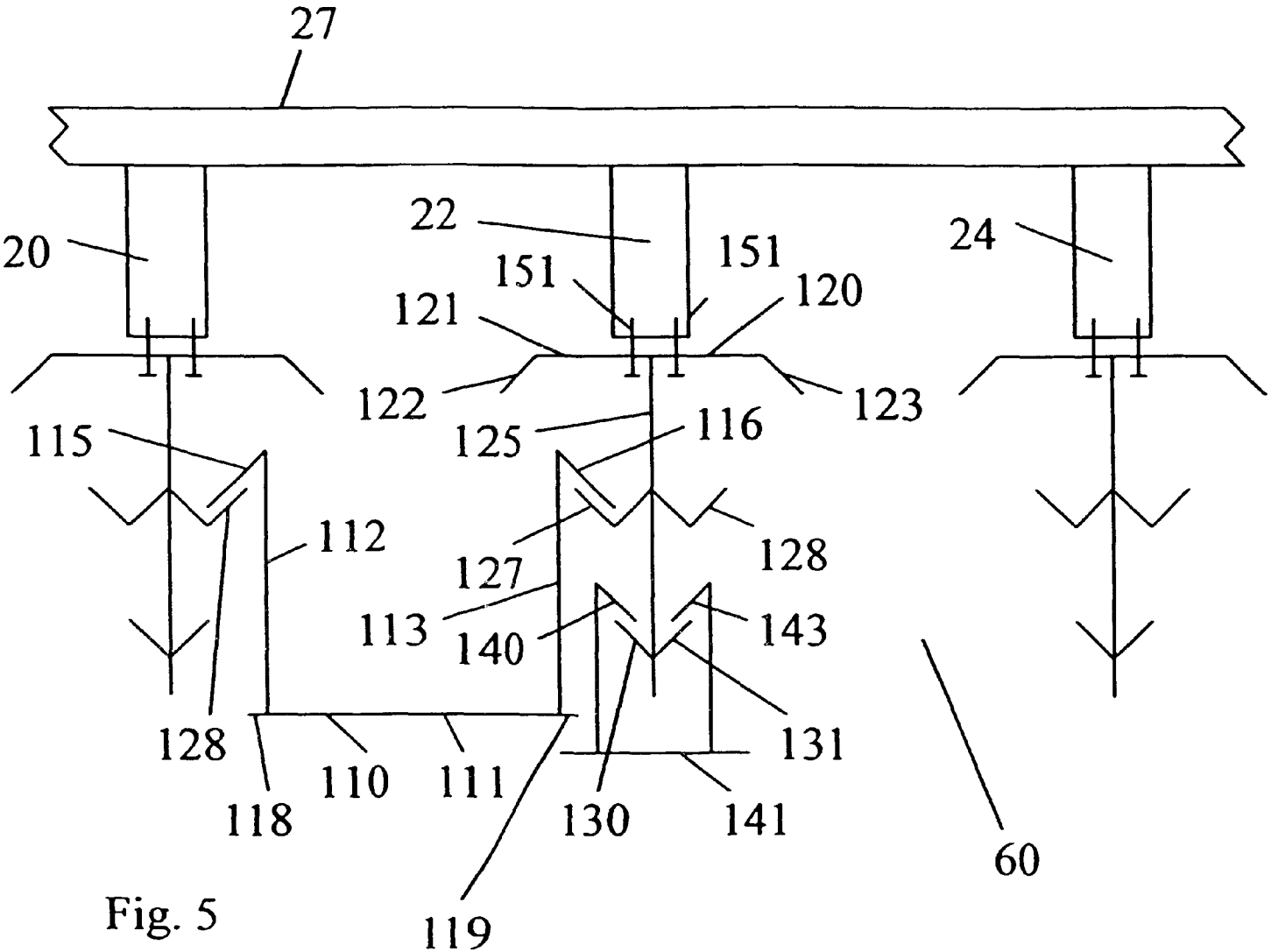
FIG. 5 is a cross-sectional view of a deck with the second embodiment deck drainage system installed.

FIG. 5 is a cross-sectional view of a deck with the second embodiment or the after market embodiment deck drainage system installed. In FIG. 5, the side of the house or structure 60 to which the deck is attached is visible, the joists 20, 22, and 24 which extend perpendicular from the side of the structure 60 are shown in cross section.

Outside embodiment clip strips 120 are shown attached to joists 20, 22, 24. The clip strips run along the length of the joists. Each clip strip 120 is comprised of a clip strip horizontal member 121 which covers the bottom edges of the joists. The horizontal members have a left diversion flange 122 attached at one edge and inclined downwardly. A right diversion flange 123 is attached at the other edge and inclined downwardly. The diversion flanges function to divert water away from the clip strip to the panels, thereby helping to prevent leaks through the deck drainage system. A vertical web 125 is attached perpendicularly to the horizontal member 121. The vertical web runs along the bottom of each joist. The panels 111 and trim strip 141 are attached to the vertical web.

Figure 2B:
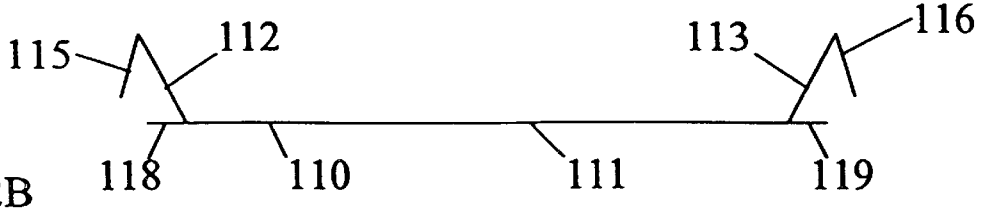
FIG. 2B is a cross-sectional view of a second embodiment panel.

There are two embodiments of panel connectors. The "outside" embodiment panel connectors are shown in FIG. 5, left V-shaped connector 127 connected to the web by left leg with the other leg extended upwardly, and right V-shaped connector 128, connected to the web by one leg with the other leg extended upwardly. Details of the V-shaped connectors are in FIG. 7A. FIG. 5 and FIG. 2B shows the "outside" embodiment panel 110. The left side wall 112 and right side wall 113 are attached to the bottom 111. A left wall flange 115 extends outside the left side wall 112 and is inclined downwardly. A right wall flange 116 extends outside the right side wall 113 and is inclined downwardly. A left finger flange 118 is attached at the intersection of the bottom 111 and left wall 112. A right finger flange 119 is attached at the intersection of the bottom 111 and right wall 113.

The outside embodiment panel is installed to the outside embodiment clip strip by overlapping the left wall flange 115 over the outer leg of the right V-shaped connector 128 and the right wall flange 116 over the outer leg of the left V-shaped connector 127.

Two upwardly-inclined flanges are attached to the clip strip below the V-shaped connectors, the left trim piece flange 130 and the right trim piece flange 131.

The trim piece 141 is made up of a trim piece horizontal web 138 and trim piece left vertical web 139 and trim piece right vertical web 142. Additional trim piece detail is in FIG. 7C. The ends of the trim piece horizontal web 138 overlap the adjacent panel bottom so that a smooth and attractive appearance on the bottom of the panels is presented. The trim piece 141 attaches to the clip strip 120 by pressing upward on the trim strip 141 so that the flanges on the trim strip vertical webs 139 and 142 overlap the left trim piece flange 130 and right trim piece flange 131, respectively.

Figure 7B:
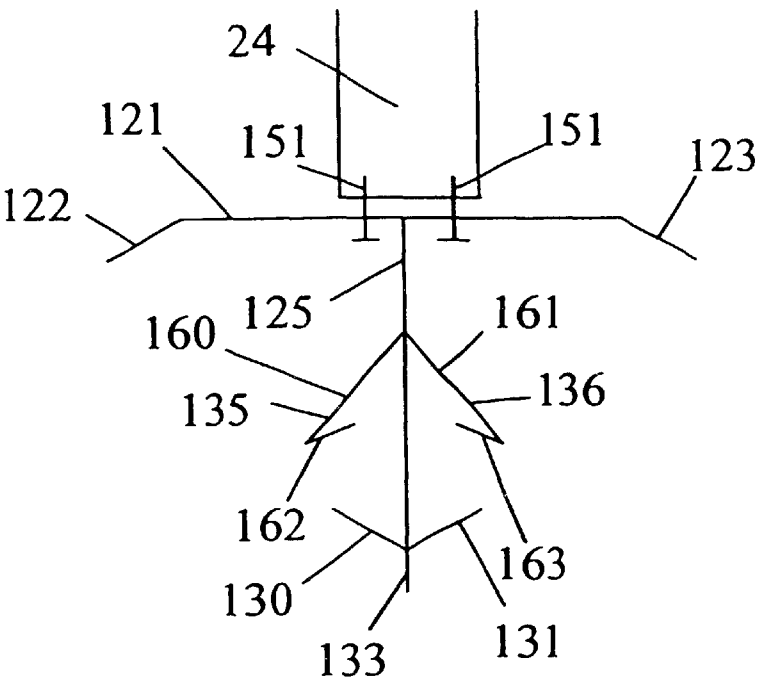
FIG. 7B is a cross-sectional view of the second embodiment clip strip used to attach the second embodiment deck drainage system to the deck.
Figure 7A:
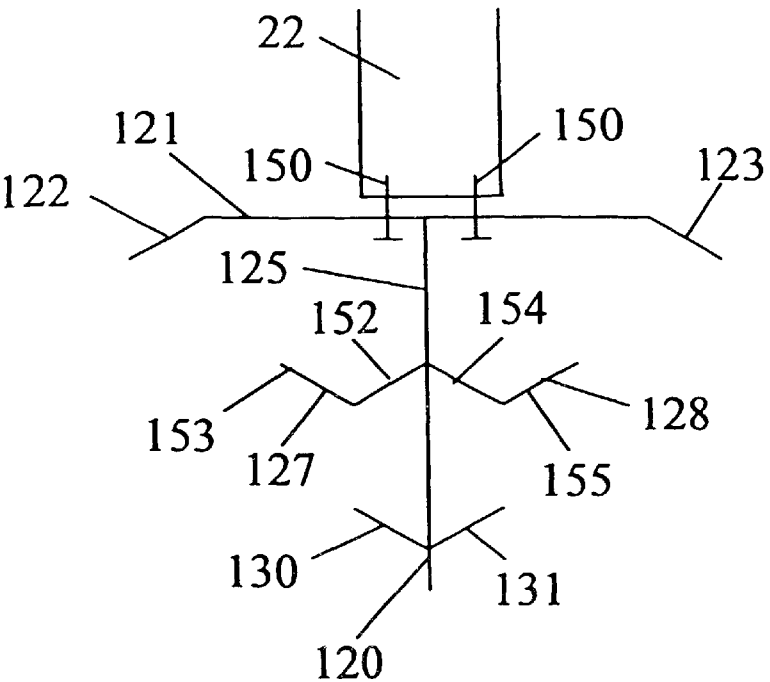
FIG. 7A is a cross-sectional view of the second embodiment clip strip used to attach the second embodiment deck drainage system to the deck.

FIG. 7A shows the outside embodiment clip strip 120 in cross-sectional view. The clip strip 120 is attached to the bottom of joist 22 by screws 150. Also visible is the clip strip horizontal web 121 with left diversion flange 122 and right diversion flange 123. The clip strip vertical web 125 is shown along with the left trim piece flange 130 and right trim piece flange 131 which are used to attach the trim piece to the clip strip. The outside embodiment clip strip is characterized by the structure of the left V-shaped connector 127 and the right V-shaped connector 128. The left V-shaped connector 127 consists of a left attached flange 152 which runs along the length of the clip strip and is attached on one end to the vertical web 125, and a left free flange 153 which is attached at one end to the left attached flange 152 and is inclined upwardly. The right V-shaped connector 128 consists of a right attached flange 154 which runs along the length of the clip strip and is attached on one end to the vertical web 125, and a right free flange 155 which is attached at one end to the right attached flange 154 and is inclined upwardly.

FIG. 7B shows the inside embodiment clip strip 133 in cross-sectional view. The clip strip 133 is attached to the bottom of joist 24 by screws or nails 151. Also visible is the clip strip horizontal web 121 with left diversion flange 122 and right diversion flange 123. The clip strip vertical web 125 is shown along with the left trim piece flange 130 and right trim piece flange 131 which are used to attach the trim piece to the clip strip. The inside embodiment clip strip is characterized by the structure of the left lazy V-shaped connector 135 and the right lazy V-shaped connector 136. The left lazy V-shaped connector 135 consists of a left downward attached flange 160 which runs along the length of the clip strip and is attached on one end to the vertical web 125 and is inclined downwardly, and a left upward free flange 162 which is attached at one end to the left downward attached flange 160 and is inclined upwardly. The right lazy V-shaped connector 136 consists of a right downward attached flange 161 which runs along the length of the clip strip and is attached on one end to the vertical web 125, and a right upward free flange 163 which is attached at one end to the right downward attached flange 161 and is inclined upwardly.

Figure 7C:
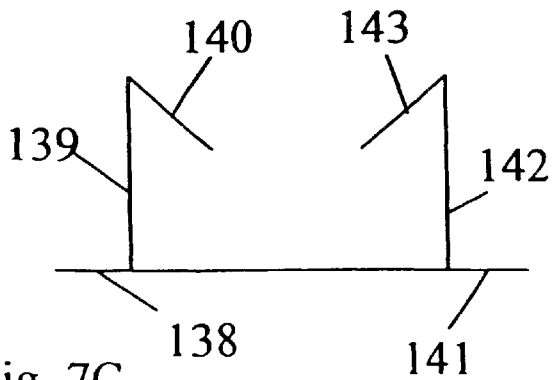
FIG. 7C is a cross-sectional view of the trim strip used with the second embodiment deck drainage system.

FIG. 7C shows a cross-sectional view of the trim piece 141. The trim piece horizontal web 138 has attached perpendicular to it a trim piece left vertical web 139 and a parallel trim piece right vertical web 142. A the end of the trim piece left vertical web 139 there is the trim piece left vertical web flange 140, which is inclined downwardly and toward the parallel trim piece right vertical web 142. A the end of the trim piece right vertical web 142 there is the trim piece right vertical web flange 143, which is inclined downwardly and toward the parallel trim piece left vertical web 139.

Figure 2C:
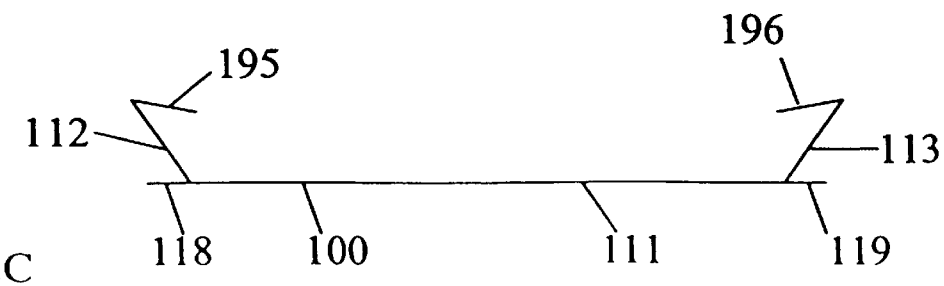
FIG. 2C is a cross-sectional view of a third embodiment panel.

FIG. 2C is a cross-sectional view of the inside embodiment panel 100. The inside embodiment is like the outside embodiment of FIG. 2B with respect to the bottom 111, left wall 112 right wall 113, left finger flange 118 and right finger flange 119. The difference between the inside and outside embodiment is in the location of the flanges at the end of the walls. In FIG. 2C, the inside embodiment, the left wall flange 195 is attached to the left wall 112 and extends downwardly toward the inside of the panel and the right wall flange 196 is attached to the right wall 113 and extends downwardly toward the inside of the panel.

The attachment of an inside embodiment panel 100 in FIG. 2C to the inside embodiment clip strip 133 in FIG. 7B is achieved by pressing the panel up so that the right lazy V-shaped connector of one clip strip engages the left wall flange of a panel, so that the left wall flange 195 overlaps the right upward free flange 163. The left lazy V-shaped connector of the other adjacent strip engages a panel at the right wall flange 196 which overlaps the left upward free flange 162 of the adjacent clip strip.

FIG. 8A shows the first embodiment interlock design, the U-shaped interlock. The bottom of first panel 101 is shown. A U-shaped interlock 40 extends downward from the bottom of first panel 101. The bottom of second panel 105 is shown with an upwardly extending U-shaped interlock 42 at one end and a downwardly extending U-shaped interlock 43 at the other end. A waterproof interconnection between panel bottoms 101 and 105 is formed by the interaction of interlocks 40 and 42. Optionally, caulk or silicone sealant can be added to the interlock to insure a waterproof connection. Although not depicted in FIG. 8A, similar U-shaped interlocks are located on the walls of the first and second panels in order to secure a waterproof connection between the first and second panel bottoms and walls.

FIG. 8B shows the second embodiment interlock design, the Z-shaped interlock. The bottom of first panel 102 is shown. A Z-shaped interlock 45 extends downward from the bottom of first panel 102. The bottom of second panel 106 is shown with an upwardly extending Z-shaped interlock 47 at one end and a downwardly extending Z-shaped interlock 48 at the other end. A waterproof interconnection between panel bottoms 102 and 106 is formed by the interaction of interlocks 45 and 47. Optionally, caulk or silicone sealant can be added to the interlock to insure a waterproof connection. Although not depicted in FIG. 8B, similar Z-shaped interlocks are located on the walls of the first and second panels in order to secure a waterproof connection between the first and second panel bottoms and walls.

FIG. 8C shows the third embodiment interlock design, the rolled interlock. The bottom of first panel 103 is shown. A rolled interlock 50 extends downward from the bottom of first panel 103. The bottom of second panel 107 is shown with an upwardly extending rolled interlock 52 at one end and a downwardly extending rolled interlock 53 at the other end. A waterproof interconnection between panel bottoms 103 and 107 is formed by the interaction of interlocks 50 and 52. Optionally, caulk or silicone sealant can be added to the interlock to insure a waterproof connection. Although not depicted in FIG. 8C, similar U-shaped interlocks are located on the walls of the first and second panels in order to secure a waterproof connection between the first and second panel bottoms and walls.

Figure 6:
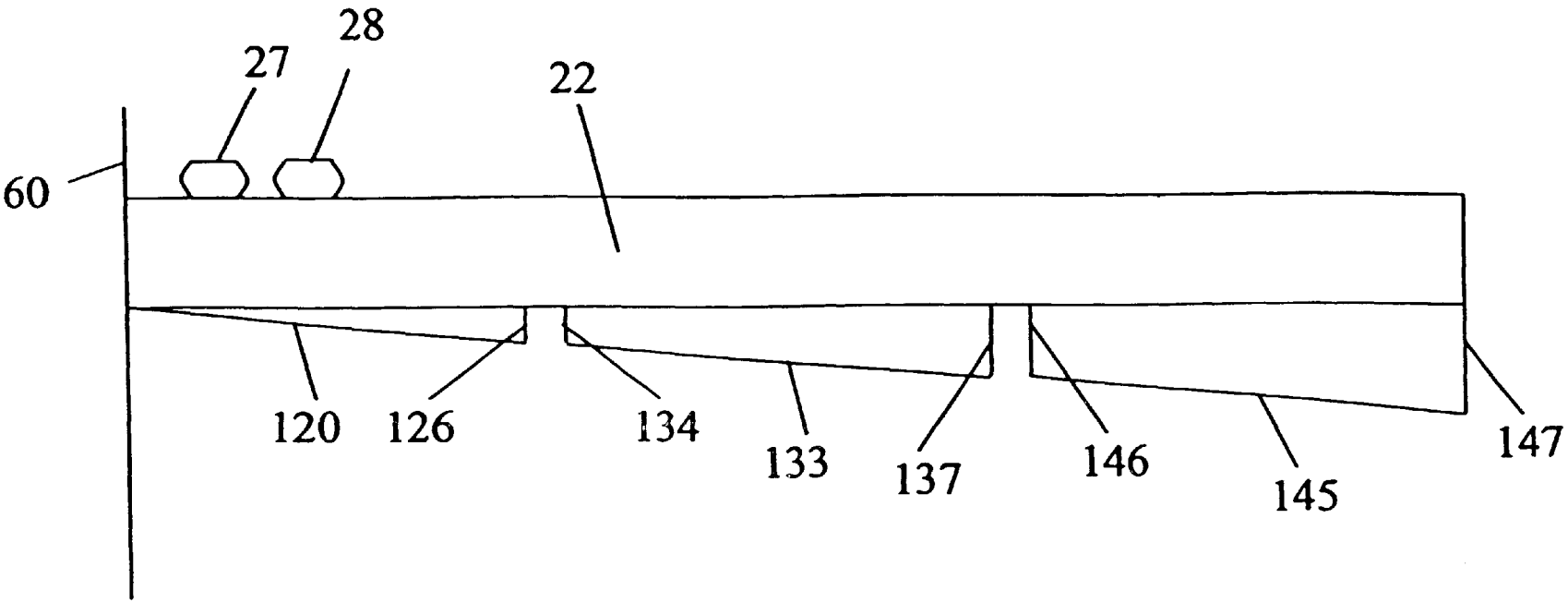
FIG. 6 is a side view of a joist with the second embodiment deck drainage system installed.

FIG. 6 is a side view along the length of a joist 22 showing the installation of the second embodiment or after market deck drainage system. Joist 22 extends from the surface of the structure wall 60 out to the edge of the deck. Two deck boards 27 and 28 are shown. The first panel 120 is closest to the structure wall, with the dam adjacent to the structure wall 60. The first panel 120 is attached by an interlock to the second panel 133 which, in turn, is attached by an interlock to the third panel 145. Details on the interlocks is shown in FIGS. 8A–C. It is important that the bottoms of the panels slope downwardly from the structure wall to the edge of the deck, to allow for drainage from the deck. In a preferred embodiment the slope is approximately ⅛" for every linear foot of panel length. In this embodiment, the side walls are 2" in height throughout all the panels. The slope is provided by an ever increasing web in the clip strip. In a preferred first panel, the web at the dam is 2" high, and at the open end 126, which is 8 feet from the dam, the web is 3" high. In the second panel, the web at the end 134 which is attached to the first panel is 3" high and the web at the other end 137 is 4" high. In the third panel, the web at the end 146 attached to the second panel is 4" high and at the other end the web is 5" high. Of course, the dimensions given here are illustrative only of a preferred example and do not limit the claims of this application.

Any suitable strong, resilient, light, corrosion-resistant, waterproof material, such as aluminum, plastic, EPDM, TPO, construction thermoplastics, fiberglass, rubber or galvanized steel, may be used to construct the deck drainage system embodiments of this invention. A preferred material for the first embodiment system is aluminum or galvanized steel, because of relatively low cost and ease of construction. Such a system can be painted on the lower surface or can remain unpainted, because it is relatively concealed by the joists. A preferred material for the second embodiment is thermoplastic such as polyurethane or high density polyethylene. Such materials have the desirable properties of easy and inexpensive construction through a molding process or extrusion and may be produced in various colors. A preferred material for the third embodiment is polymer comprised of ethylene, propylene, and diene monomer (EPDM). EPDM membranes may include various colors including black. They may or may not be reinforced by polyester or fiberglass. Another suitable thermoset membrane is comprised of neoprene. Another preferred material for the third embodiment is polymer comprised of polypropylene and ethylene propylene rubber, termed TPO, for thermoplastic polyolefin. Most of these materials are available in fire retardant formulations, which is preferred.

The first embodiment deck drainage system is installed during construction of the deck. Specifically, as shown in FIG. 3, after the joists 20, 22, and 24 are installed and before the deck boards 27 are installed, the panel 10 is placed between joists 20 and 22. Similarly, panel 25 is placed between joists 22 and 24. The horizontal ribs, 14 and 16 of panel 10, rest on the tops of the joists 20 and 22, respectively. The horizontal rib 216 of panel 25, rests on the top of the joist 24. The intersection between adjacent panels 10 and 25 is overlapped and sealed against water leakage by the left horizontal rib 214 and left panel flange 215 of panel 25 which overlaps the right horizontal rib 16 of panel 10. The first embodiment panels are held in place by nail, staple, or screw fasteners, in FIG. 3, nails 29 which are driven through the deck boards into the joists. The first embodiment panels are therefore installed permanently. A similar arrangement is used to add the second and additional panels to the first embodiment system.

The second embodiment system is an add-on system which is added to an existing deck. FIG. 5 shows the clip strips 120 are installed by fastening by screws or nail fasteners 151 which fasten the clip strips to the bottom of the joists 20, 22, 24. A second embodiment panel 110 is attached to two adjacent clip strips 120 by pressing the panel up between two adjacent joists 20, 22 with attached clip strips until the fastening flanges 115, 116 on the panel are over the corresponding fastening flanges 127, 128, respectively, attached to the clip strip. The finger flanges 118, 119 are grasped and pulled down in order to seat the panel in the fasteners. After the panels are installed, the trim strip 141 is installed by pushing the trim strip 141 up between adjacent panels until the clip strip 120 left and right fastener flanges, 130 and 131, respectively, engage with the left and right trim strip flanges 140 and 143, respectively. Additional trim strip details are shown in FIG. 7C. A similar arrangement is used to add the second and additional panels to the second embodiment system. Although the second embodiment deck drainage system can be removed if desired, in normal anticipated usage the installation is permanent.

The third embodiment system is constructed of flexible, flame retardant rubber or polymeric material which optionally has fiberglass embedded therein. The panel is trapezoid shaped so that when it is installed with a consistent overlap over adjacent and parallel joists, the panel will form a trough and provide a fall or pitch from the portion nearest the structure (inside end) to the end nearer to the edge of the deck (outside end) of from ⅛ inch per foot to ¼ inch per foot. In cross section the installed panel forms a hemisphere. For example, if the panel is 8 foot long, and a fall of ¼ inch per foot is desired, the outside end would be 2 inches wider than the inside end.

Figure 9:
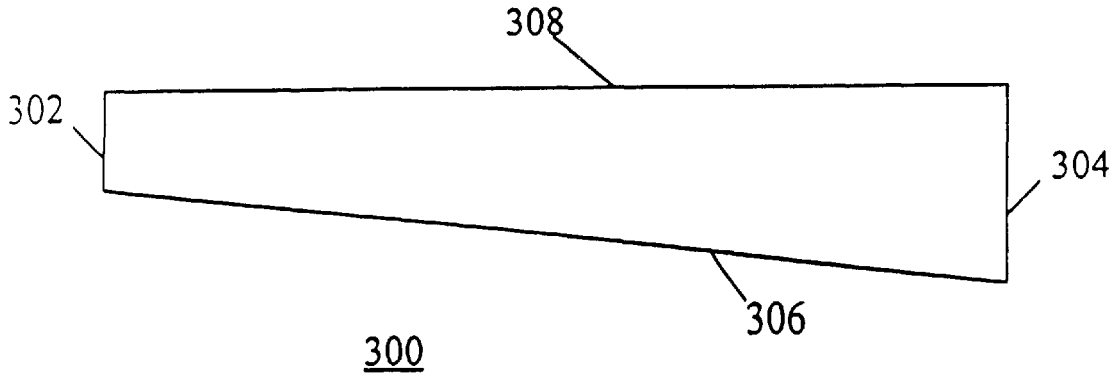
FIG. 9 is a top view of a third embodiment system panel.

FIG. 9 shows the third embodiment system panel 300 with inside end 302 parallel to outside end 304 and left side 306 equal in length to right side 308. The third embodiment panel is provided in rolls of sufficient length to span the deck from the building to the edge of the deck. There is no need to connect individual panels of the third embodiment system in order to span a wide deck.

The third embodiment deck drainage system panels are made of flexible material of gauge 0.010–0.060, (10 mil–60 mil). This gauge has been found to be flexible enough to allow development of the necessary fall yet resilient enough to resist the development of pooling of water on the panels. In addition, third embodiment panels are resilient enough to resist puncturing by debris falling from the deck or incidental contact from below the deck. The panels are supplied precut and rolled for convenience in handling.

Suitable materials for the third embodiment panel fall into three categories, thermoset, thermoplastic, and modified bitumen membranes, all commonly used for single-ply roofing.

Thermoset membranes are comprised of rubber polymers. A preferred polymer is comprised of ethylene, propylene, and diene monomer (EPDM). EPDM membranes may include various colors including black. They may or may not be reinforced by polyester or fiberglass. Another suitable thermoset membrane is comprised of neoprene.

Thermoplastic membranes are based on plastic polymers, such as polyvinyl chloride (PVC), and include plasticizers to maintain flexibility. They may optionally be reinforced by polyester or fiberglass. PVC membranes are highly fire resistant and retardant. Thermoplastic polyoelfins (TPO) are based on polypropylene and ethylene propylene rubber and may include EPDM in the blend. Fire resistance and retardance in TPO is obtained by including in the formulation brominated compounds or hydrated mineral salts. Reinforced TPO membranes can be produced by calendering with lamination, extrusion with lamination or extrusion-coating. Reinforcement may be with polyester, fiberglass, or other reinforcements.

Modified bitumen membranes are factor fabricated with layers of asphalt modified with a rubber or plastic ingredient for increased flexibility and with reinforcement by polyester or other plastic material or fiberglass for added strength. Commonly added modifiers include atactic polypropylene and styrene butadiene styrene.

The preferred materials as described above withstand ultraviolet light and ozone, saltwater in direct spray and in the air, incidental contact and abuse, rough jobsite handling, caustic accumulation of debris, acid rain, snow and ice build up, and remain resilient during extreme temperature changes.

A preferred membrane for the third embodiment system is EPDM Roofing Membrane obtainable from Firestone Building Products Company of Carmel, Indiana. Another preferred membrane is ULTRAPLY TPO obtainable from Firestone Building Products Company of Carmel, Ind.

Figure 10:
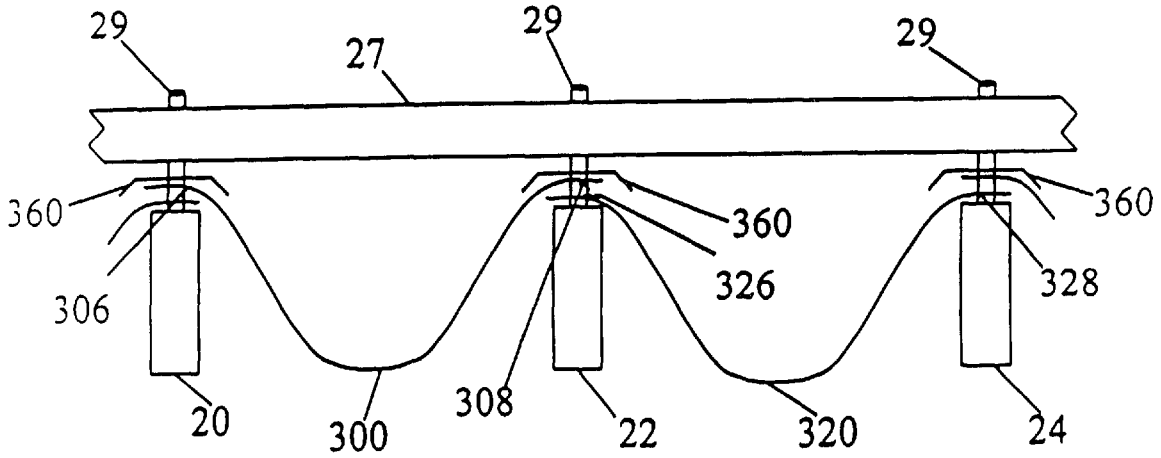
FIG. 10 is a cross-sectional view of a deck with a third embodiment system installed.

FIG. 10 shows the third embodiment deck drainage system which is installed during construction of the deck. Specifically, after the joists 20, 22, and 24 are installed and before the deck boards 27 are installed, the panel 300 is placed between joists 20 and 22. Similarly, panel 320 is placed betweenjoists 22 and 24. The left edge 306, of panel 300, rest on the top of joist 20. The right edge 308 rests on the top of joist 22. The left edge 326 of panel 320 rests on top of right edge 308 of panel 300 on top of joist 22. The right edge 328 rests on top of joist 24. Since each panel overlaps each joist by an equal amount, approximately 1½ inch, the progressively increasing width of the panel provides the fall necessary to assure that water will run off of the panel and not pool or collect in the length of the panel.

The intersection between adjacent panels 300 and 320 is overlapped and sealed against water leakage by diversion flanges 360. The diversion flanges 360 serve to divert water from the deck into the panels and prevents backflow of water and seepage into the joint formed by the overlapping panels. The diversion flanges are constructed of light, impervious, fire retardant material such as fire retardant plastic, galvanized steel, aluminum, or EPDM. . The third embodiment panels are held in place by nail, staple, or screw fasteners. In FIG. 10, nails 29 which are driven through the deck boards into the joists secure the panels. The third embodiment panels are therefore installed permanently. A soap pencil line is drawn on the center of the diversion flange along the length of the diversion flange. This line aids in insuring that the nails or other fasteners used are properly seated in the joist. The amount of fall in the panel is determined by the length of run and by the width of the outside end of the panel.

The fourth embodiment system is an add-on system which is added to an existing deck. The fourth embodiment uses a panel from the third embodiment which has been modified by the attachment of a metal or plastic hanger clip 370 in FIG. 11 which is attached to and runs parallel to the sides of the panel. The hanger clips attach to the mounting flanges 380 which are attached along the top inner surfaces of the joists and run parallel to the top of the joists. The fall in the third embodiment system panel is developed by the progressive widening of that panel and is therefore expressed in the fourth embodiment system and provides the necessary fall in the fourth embodiment system.

Figure 11:
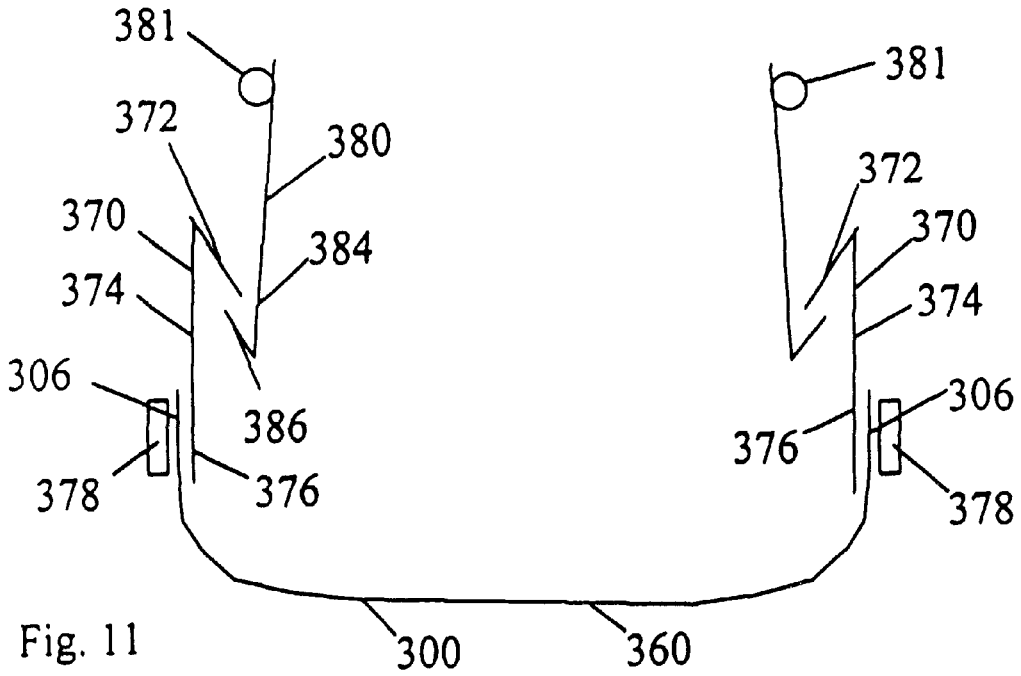
FIG. 11 is a cross-sectional view of a fourth embodiment system including the panel, mounting flange, attachment clips, and joiner strip.

FIG. 11 is a cross section of the fourth embodiment system which is installed on existing decks. The panel 360 of the fourth embodiment system is comprised of a third embodiment system panel 300 to which is attached a hanger clip 370 on each side of the panel. The hanger clip 370 is constructed of a flexible, resilient material such as aluminum or plastic and consists of a web 374 with a hook 372 at the top of the web and a connecting overlap 376 at the bottom of the hanger clip. About one and one-half inch of the left edge 306 of the panel 360 is overlapped by about one and one-half inch of the hanger clip 370. The overlap is secured by adhesive or mechanical fasteners and the seal is reinforced by a binder bar 378. The binder bar is a long strut-like member constructed of wood or plastic which extends the length of the panel and insures a strong connection between the edge of the panel 360 and the hanger clip 370.

The panel is attached to the underside of the deck by a mounting bracket 380 which runs along the sides of the joists below the deck from building 60 to the end of the joists. The mounting bracket 380 is constructed of strong resilient material such as aluminum, steel, or plastic. A preferred material is fire retardant plastic. The mounting bracket 380 consists of a web 384, and a hook 386 on the bottom of the web. In use, the hook 386 interacts with the hook 372 on the panel 360. A bead 381 of construction adhesive or caulk is placed between the top portion of the mounting bracket 380 and the joist to which the mounting bracket is attached in order to seal against the infiltration of water. It should be noted that the hook 386 on the mounting bracket may be shorter than the hook 372 on the top of the hanger clip 370. This insures that any moisture which should seep behind the mounting bracket 380 is conveyed by the hook 386 into the panel. This insures such seepage does not fall into the dry area under the deck.

The mounting bracket 380 is identical to and interchangeable with the hanger clip 370.

Figure 12:
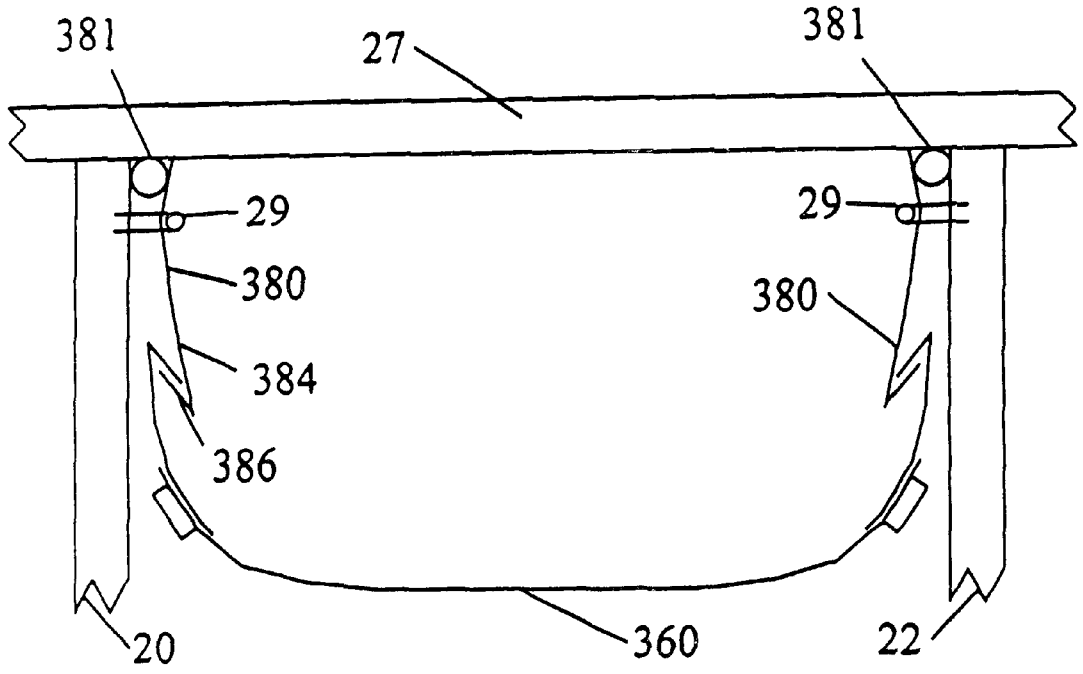
FIG. 12 is a cross-sectional view of an installed fourth embodiment system.

FIG. 12 shows the installation of the fourth embodiment system panel 360 under an existing deck. The mounting bracket 380 is installed on the long axis of the joists 20, 22 close to the bottom of the deck boards 27. Before the mounting bracket 380 is installed, an adhesive or sealant 381, such as PL 500 polyurethane adhesive, available from ChemRex, Inc./Sonneborn, Shakopee, Minn. is applied to either or both the joists or the backside of the mounting bracket. The sealant insures that water from the deck does not seep between the mounting bracket and joists into the dry area below the deck. The mounting brackets 380 are held in place by nail, staple, or screw fasteners, in FIG. 12, nails 29 are driven through the mounting brackets into the joists. The fourth embodiment system panel 360 is installed by pushing upward on the panel until the hooks on the panel and the mounting bracket interlock.

The panels of the fourth embodiment system are cut to lengths of 10, 12, 14, 16, and 20 or more feet and no joints between panels are necessary to span the width of the deck. Although the fourth embodiment deck drainage system can be removed if desired, in normal anticipated usage the installation is permanent.

Figure 13:
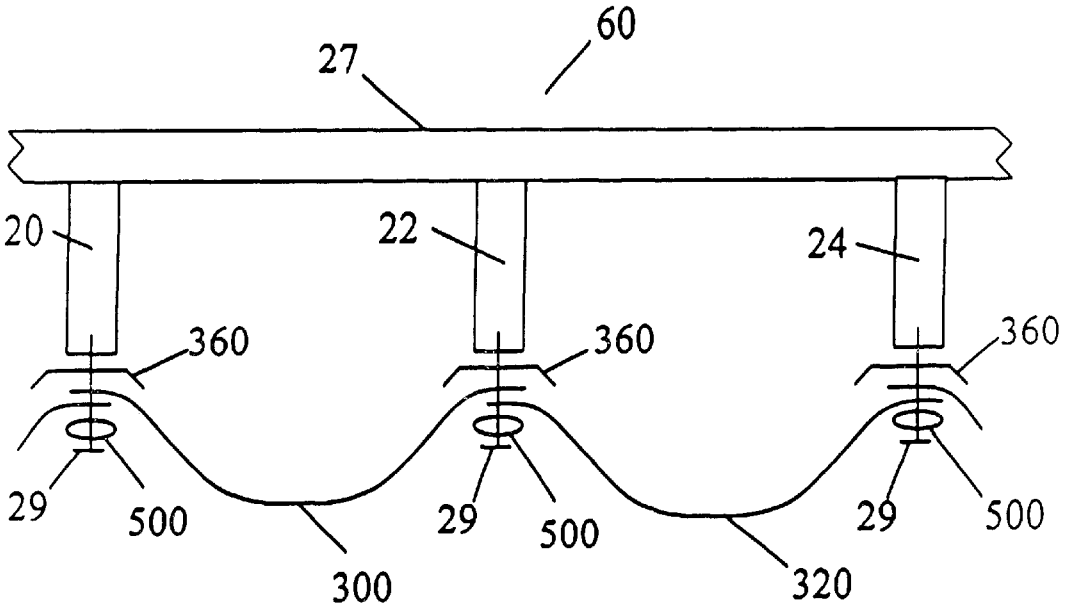
FIG. 13 is a cross-sectional view of an installed fifth embodiment system.

FIG. 13 shows a cross-sectional view of the fifth embodiment system. Visible in FIG. 13 are the deck board 27 and joists 20, 22, and 24. The side of the building 60 is also shown in FIG. 13. The panels 300 and 320 of the fifth embodiment system are identical to the panels of the third embodiment system. The fifth embodiment system differs from the third embodiment system in that the fifth embodiment system is mounted to the bottoms of the joists of an existing deck, rather than be incorporated into new deck construction, as is the third embodiment system. A diversion flange 360, which is identical to the diversion flange of the third embodiment system, is attached by fasteners such as nails or staples along the length of the joists 20, 22, 24. The diversion flange is oriented with the concave portion down so that water flowing from the top of the deck is diverted away from the bottom of the joists. The panels 300 and 320 are attached by tacks or staples to the bottoms of the diversion flanges 360. Note that the edges of the panels overlap. Finally, a compression flange 500 is securely and permanently fastened to the bottom of the joists using fasteners such as screws or nails 29. The compression flange 500 is an elongated piece of wood or plastic similar to a furring strip which serves to tightly bind and seal the panels and the diversion strip against the leakage of water.

Figure 14:
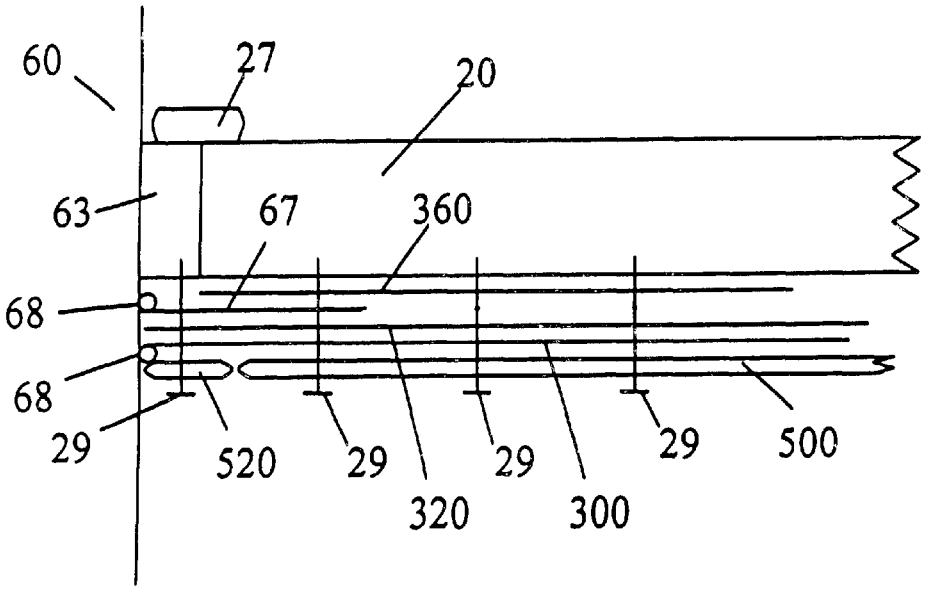
FIG. 14 is a side view of an installed fifth embodiment system.

FIG. 14 is a side view of the fifth embodiment system showing in particular the structure where the deck is attached to the building. The building 60 has attached to it a ledger board 63 to which the joist 20 is attached. A deck board 27 is shown resting on top of the ledger board 63 and joist 20. A diversion flange 360 is shown attached along the length of the joist 20, with the exception that the diversion flange 360 does not cover the bottom of the ledger board 63. This allows for the creation of a good seal between the building 60 and the headwater flashing 67 using a bead of sealant 68. The headwater flashing extends some 8 to 12 inches away from the building between the diversion flange 360 and the uppermost panel 320. Drain panels 320 and 300 are then overlapped and another bead of sealant 68 is added to the bottom of the bottommost drain panel 300. A headwater flashing compression flange 520 is permanently installed along the length of the ledger board 63 and fastened to the bottom of the ledger board 63 using fasteners such as nails or screws 29. The headwater flashing compression flange 520 acts to tightly bind and seal the flashing and panels and diversion strip at the ledger board 63 and is analogous to the compression flange 500 in this function. Compression flange 500 is permanently attached to the bottom of the joist 20 along its length.

The fifth embodiment system serves the same function of the other four embodiments, that of capturing and channeling rain, snow, or other waste water from the deck to a gutter and down spout system while maintaining the area below the deck in a dry condition. The fifth embodiment has the advantage of being capable of installation to an existing deck by an average handyperson, such as a home owner, using tools commonly found in the home.

It will be apparent to those skilled in the art that the examples given here are illustrative only, and that this invention is limited only by the appended claims.

I claim:

1. A drainage system for decks attached to buildings which is modular in construction and adapted for installation on decks of various widths, for mounting below the joists of a wooden or composite deck for receiving water that passes through the deck, and for directing the water for disposal away from the area below the deck, thereby maintaining the area below the deck in a dry state, comprising:

a generally gutter-shaped panel mounted below the joists of a wooden or composite deck, the panel having a trapezoid shape with a short end, a long end, and two equal sides connecting the ends, the panel comprised of thermoset, thermoplastic, or modified bitumen membrane.

2. The system of claim 1 wherein the membrane is comprised of EPDM.

3. The system of claim 1 wherein the membrane is comprised of TPO.

4. The system of claim 1 wherein the membrane is fire retardant.

5. The system of claim 1 wherein the membrane is mounted with edges overlapping the bottoms of adjacent joists.

6. The system of claim 1 further comprising diversion flanges mounted on the bottoms of adjacent joists.

7. The system of claim 1 wherein the panel is mounted with the short end nearest the building.

* * * * *